US010519003B2

(12) United States Patent
Okuda

(10) Patent No.: US 10,519,003 B2
(45) Date of Patent: Dec. 31, 2019

(54) ELEVATOR OPERATION PANEL

(71) Applicant: MITSUBISHI ELECTRIC CORPORATION, Chiyoda-ku (JP)

(72) Inventor: Hiroshi Okuda, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 377 days.

(21) Appl. No.: 15/540,372

(22) PCT Filed: Mar. 13, 2015

(86) PCT No.: PCT/JP2015/057447
§ 371 (c)(1),
(2) Date: Jun. 28, 2017

(87) PCT Pub. No.: WO2016/147249
PCT Pub. Date: Sep. 22, 2016

(65) Prior Publication Data

US 2017/0362053 A1 Dec. 21, 2017

(51) Int. Cl.
*B66B 1/52* (2006.01)
*B66B 11/02* (2006.01)

(52) U.S. Cl.
CPC ..... *B66B 1/52* (2013.01); *B66B 11/02* (2013.01)

(58) Field of Classification Search
CPC ..... B66B 1/52; B66B 11/02
USPC ..... 187/395
See application file for complete search history.

(56) References Cited

U.S. PATENT DOCUMENTS 4,716,992 A * 1/1988 Kunii ..... B66B 1/461 187/391
5,379,865 A * 1/1995 Berdich ..... B66B 3/00 187/398
5,477,942 A * 12/1995 Shea ..... B66B 1/462 187/395

(Continued)

FOREIGN PATENT DOCUMENTS

JP 5-85541 A 4/1993
JP 11-60116 A 3/1999

(Continued)

OTHER PUBLICATIONS

International Search Report dated May 12, 2015 in PCT/JP2015/057447 filed Mar. 13, 2015.

(Continued)

*Primary Examiner* — David S Warren
(74) *Attorney, Agent, or Firm* — Xsensus LLP

(57) ABSTRACT

In an elevator operation panel, a base of a casing includes a back plate portion, a lateral plate portion, and a vertical plate portion. An outer surface of the lateral plate portion, which faces the exterior of the casing, and a vertical direction end surface of the vertical plate portion on the lateral plate portion side are disposed in an identical plane. An L-shaped slit is provided between the back plate portion and the lateral plate portion. The slit includes a rectilinear portion, and a projecting portion that projects into the back plate portion. In a condition where the lateral plate portion is bent relative to the back plate portion, a surface of the lateral plate portion that faces the rectilinear portion overlaps a surface of the back plate portion on an opposite side to a wall.

2 Claims, 10 Drawing Sheets

(56) References Cited

U.S. PATENT DOCUMENTS

| | | | | | |
|---|---|---|---|---|---|
| 5,490,581 | A * | 2/1996 | Warner | B66B 3/00 | 187/395 |
| 5,584,366 | A * | 12/1996 | Durand | H02B 1/048 | 187/414 |
| 5,780,790 | A * | 7/1998 | Benson | B66B 3/00 | 187/395 |
| 5,829,554 | A * | 11/1998 | Benson | B66B 1/466 | 187/414 |
| 6,029,778 | A * | 2/2000 | Lacarte Estallo | B66B 1/465 | 187/414 |
| 6,227,335 | B1 * | 5/2001 | Koeppe, Jr. | B66B 1/462 | 187/395 |
| 7,714,244 | B1 * | 5/2010 | De Pedro | H01H 13/86 | 187/395 |
| 8,348,022 | B2 * | 1/2013 | Rusanen | B66B 1/461 | 187/391 |
| 2006/0196735 | A1 * | 9/2006 | Long | B66B 11/02 | 187/401 |
| 2009/0260873 | A1 | 10/2009 | Konoma | | |
| 2017/0362053 | A1 * | 12/2017 | Okuda | B66B 11/02 | |
| 2018/0086595 | A1 * | 3/2018 | Guillot | B66B 1/52 | |
| 2018/0339878 | A1 * | 11/2018 | Fever | B66B 1/463 | |
| 2019/0235563 | A1 * | 8/2019 | Makela | G05G 1/02 | |

FOREIGN PATENT DOCUMENTS

| | | | |
|---|---|---|---|
| JP | 2001-217574 | A | 8/2001 |
| JP | 2003-86960 | A | 3/2003 |
| JP | 2006-27841 | A | 2/2006 |
| JP | 2009-260024 | A | 11/2009 |
| JP | 2013-56715 | A | 3/2013 |
| JP | 2014-39952 | A | 3/2014 |

OTHER PUBLICATIONS

Japanese Office Action dated Dec. 19, 2017 in Japanese Patent Application No. 2017-505764, 6 pages (with unedited computer generated English translation).

* cited by examiner

ELEVATOR OPERATION PANEL

TECHNICAL FIELD

This invention relates to an elevator operation panel, such as a car operation panel provided inside a cage or a landing operation panel provided on a landing, for example.

BACKGROUND ART

In a type of elevator, among conventional elevators, in which a casing of a car operation panel is embedded in a cage wall (a wing wall or a side face wall), the front surface is the only part of the car operation panel that is exposed to the cage interior.

In a type of elevator in which the car operation panel is fixed to the surface of the cage wall, however, the casing of the car operation panel is exposed to the cage interior, which is undesirable in terms of design. Moreover, when the cage wall deforms unexpectedly, an angled portion of the casing may protrude from the cage wall and become caught on clothing, luggage, or the like. Furthermore, when the angled portion of the casing is sharp, great care must be taken not to damage the cage wall and so on during installation, which is undesirable in terms of workability.

In a conventional control panel casing proposed in response to these problems, a slit is provided between a side plate portion and an upper plate portion of a partition plate (see PTL 1, for example).

CITATION LIST

Patent Literature

[PTL 1] Japanese Patent Application Publication No. 2001-217574

SUMMARY OF THE INVENTION

Problem to be Solved by the Invention

However, even with the conventional control panel casing described above, when the control panel casing is applied to a type of elevator in which the car operation panel is fixed to the surface of the cage wall, the sharp angled portions are exposed to the cage interior, and therefore, when the cage wall deforms unexpectedly, the angled portions may become caught on clothing or luggage. Moreover, the workability decreases during installation.

This invention has been designed to solve the problems described above, and an object thereof is to obtain an elevator operation panel with which the exposure of sharp angled portions can be reduced.

Means for Solving the Problem

An elevator operation panel according to this invention includes a casing having a base and a cover joined to the base, wherein: the base includes a back plate portion fixed to a wall, a lateral plate portion projecting at a right angle toward the cover side from a vertical direction end portion of the back plate portion, and a vertical plate portion projecting at a right angle toward the cover side from a width direction end portion of the back plate portion; the back plate portion, the lateral plate portion, and the vertical plate portion are formed by bending a single flat plate; an outer surface of the lateral plate portion, which faces the exterior of the casing, and a vertical direction end surface of the vertical plate portion on the lateral plate portion side are disposed in an identical plane; an L-shaped slit is provided between the back plate portion and the lateral plate portion; the slit includes a rectilinear portion provided to extend in a width direction of the lateral plate portion from a width direction end portion of the lateral plate portion on the vertical plate portion side, and a projecting portion that projects into the back plate portion from an end portion of the rectilinear portion on an opposite side to the vertical plate portion; and in a condition where the lateral plate portion is bent relative to the back plate portion, a surface of the lateral plate portion that faces the rectilinear portion overlaps a surface of the back plate portion on an opposite side to the wall.

Further, an elevator operation panel according to this invention includes a casing having a base and a cover joined to the base, wherein: the base includes a back plate portion fixed to a wall, a lateral plate portion projecting at a right angle toward the cover side from a vertical direction end portion of the back plate portion, and a vertical plate portion projecting at a right angle toward the cover side from a width direction end portion of the back plate portion; the back plate portion, the lateral plate portion, and the vertical plate portion are formed by bending a single flat plate; an outer surface of the vertical plate portion, which faces the exterior of the casing, and a width direction end surface of the lateral plate portion on the vertical plate portion side are disposed in an identical plane; an L-shaped slit is provided between the back plate portion and the vertical plate portion; the slit includes a rectilinear portion provided to extend in a vertical direction from a vertical direction end portion of the vertical plate portion on the lateral plate portion side, and a projecting portion that projects into the back plate portion from an end portion of the rectilinear portion on an opposite side to the lateral plate portion; and in a condition where the vertical plate portion is bent relative to the back plate portion, a surface of the vertical plate portion that faces the rectilinear portion overlaps a surface of the back plate portion on an opposite side to the wall.

Effects of the Invention

With the elevator operation panel according to this invention, by providing the L-shaped slit, a hole formed during bending can be shifted to the back plate portion, and as a result, the exposure of sharp angled portions can be reduced.

DESCRIPTION OF EMBODIMENTS

Embodiments of this invention will be described below with reference to the drawings.

First Embodiment

Figure 1:
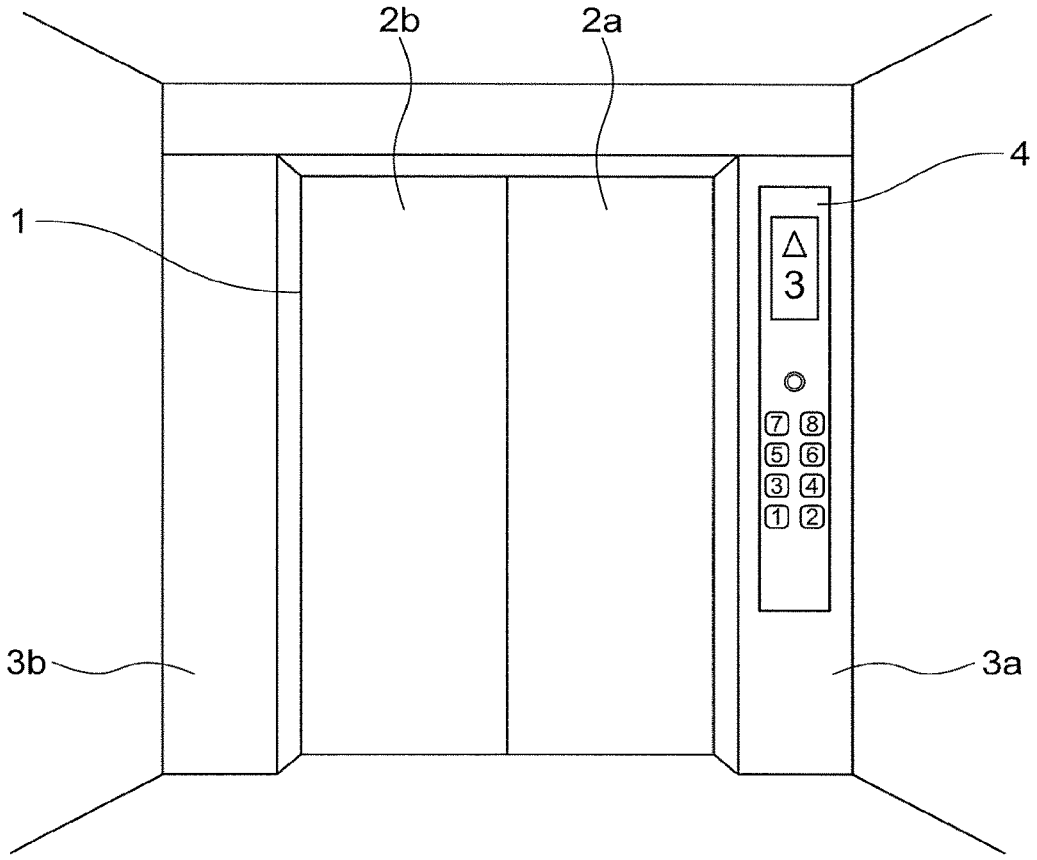
FIG. 1 is a front view showing an arrangement of a car operation panel for an elevator according to a first embodiment of this invention.

FIG. 1 is a front view showing an arrangement of a car operation panel for an elevator according to a first embodiment of this invention. In the drawing, a pair of car doors 2*a*, 2*b* for opening and closing a car doorway 1 are provided on a front surface of a cage. A pair of wing walls 3*a*, 3*b* are provided on respective sides of the car doorway 1. A car operation panel 4 is fixed to the wing wall 3*a*.

Figure 2:
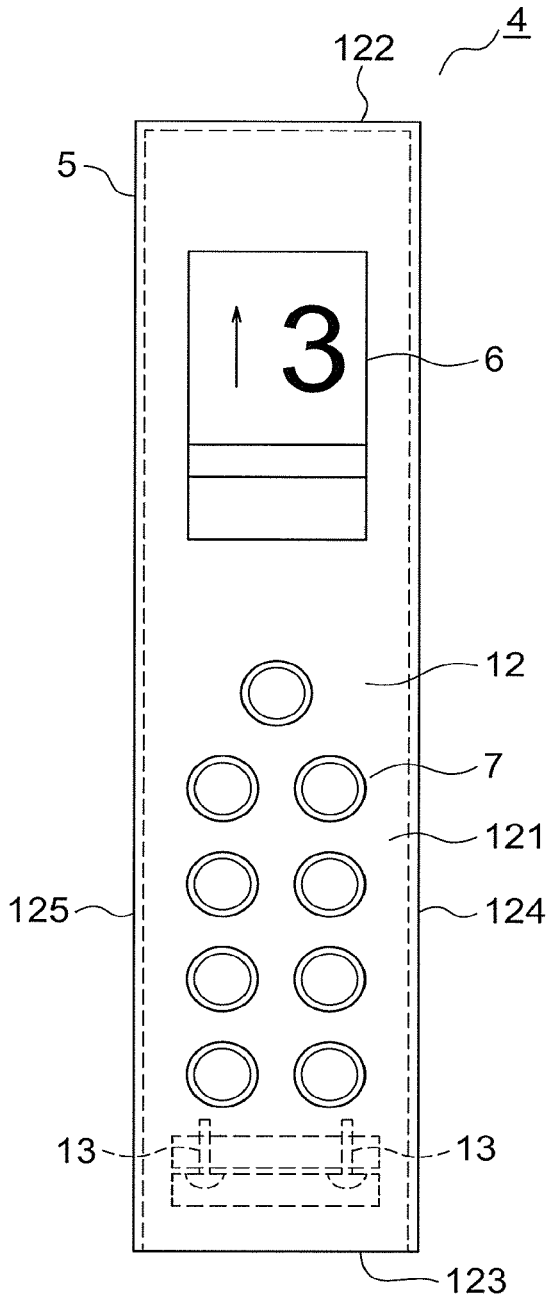
FIG. 2 is an enlarged front view showing the car operation panel of FIG. 1.
Figure 3:
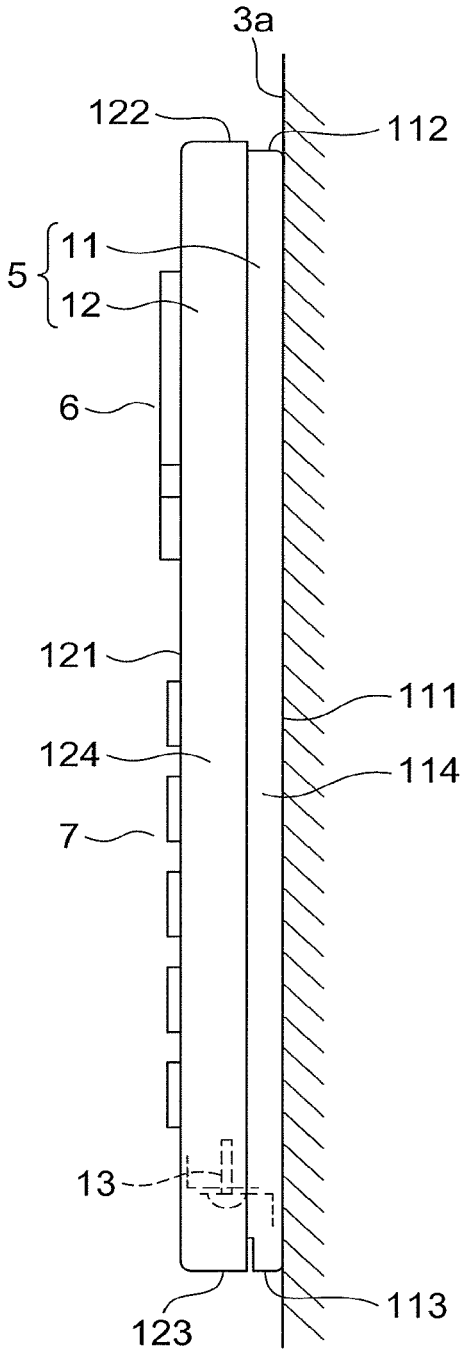
FIG. 3 is a right side view showing the car operation panel of FIG. 2.
Figure 4:
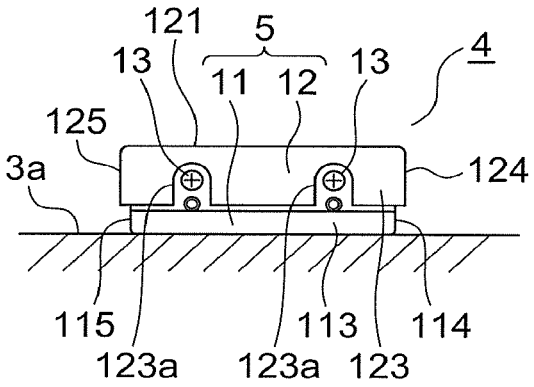
FIG. 4 is a bottom view showing the car operation panel of FIG. 2.

FIG. 2 is an enlarged front view showing the car operation panel 4 of FIG. 1. FIG. 3 is a right side view showing the car operation panel 4 of FIG. 2. FIG. 4 is a bottom view showing the car operation panel 4 of FIG. 2. The car operation panel 4 includes a casing 5 and a plurality of operation panel devices incorporated into the casing 5.

The operation panel devices include an indicator 6, a car operating button device 7, a control box (not shown), and so on. An LED indicator, for example, is used as the indicator 6. A plurality of destination floor specifying buttons that are operated from inside the cage are provided in the car operating button device 7.

The casing 5 has a thin, vertically long outer shape in which a height dimension (a dimension in a vertical direction of FIG. 2) is larger than a width dimension (a dimension in a left-right direction of FIG. 2) and a thickness dimension (a dimension in a left-right direction of FIG. 3) is smaller than the width dimension.

Further, the casing 5 includes a base (a box) 11 fixed to the wing wall 3*a*, and a cover (a face plate) 12 joined to the base 11. The cover 12 is fixed to the base 11 by two screws 13 in a lower portion of the casing 5.

The base 11 includes a back plate portion 111 that overlaps and is fixed to a surface of the wing wall 3*a*, a base upper plate portion 112 that projects at a right angle toward the cover 12 side (an opposite side to the wing wall 3*a*) from an upper end portion of the back plate portion 111, a base lower plate portion 113 that projects at a right angle toward the cover 12 side from a lower end portion of the back plate portion 111, and first and second base side plate portions 114, 115 that project at right angles toward the cover 12 side from respective width direction end portions of the back plate portion 111.

The back plate portion 111, the base upper plate portion 112, the base lower plate portion 113, the first base side plate portion 114, and the second base side plate portion 115 are formed by bending a single flat steel plate. The back plate portion 111 has a rectangular surface shape.

The cover 12 includes a front surface portion 121 that opposes the back plate portion 111, a cover upper plate portion 122 that projects at a right angle toward the base 11 side (the wing wall 3*a* side) from an upper end portion of the front surface portion 121, a cover lower plate portion 123 that projects at a right angle toward the base 11 side from a lower end portion of the front surface portion 121, and first and second cover side plate portions 124, 125 that project at right angles toward the base 11 side from respective width direction end portions of the front surface portion 121.

The cover upper plate portion 122 partially overlaps the base upper plate portion 112. The first cover side plate portion 124 partially overlaps an outer side of the first base side plate portion 114. The second cover side plate portion 125 partially overlaps an outer side of the second base side plate portion 115.

A base 11 side end surface of the cover lower plate portion 123 opposes a cover 12 side end surface of the base lower plate portion 113. A pair of tool insertion holes 123*a* for inserting a tool for rotating the screws 13, for example a screwdriver, are provided in the cover lower plate portion 123 serving as a lower end portion of the casing 5.

Figure 5:
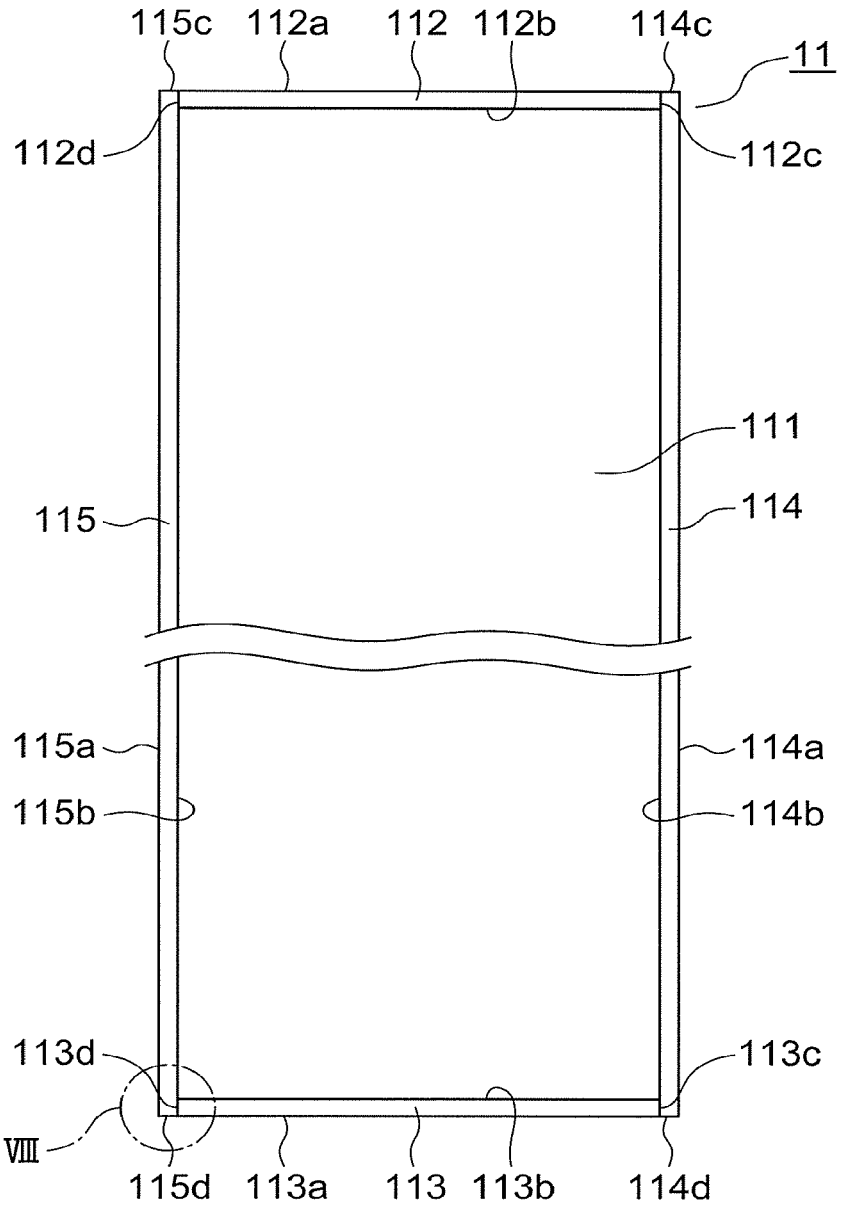
FIG. 5 is a front view showing a base of FIG. 3.

FIG. 5 is a front view showing the base 11 of FIG. 3. The base upper plate portion 112 includes an upper plate portion upper surface 112*a*, serving as an outer surface that faces the exterior of the casing 5, an upper plate portion lower surface 112*b* serving as an inner surface that faces the interior of the casing 5, a width direction first end surface 112*c*, and a width direction second end surface 112*d*.

The base lower plate portion 113 includes a lower plate portion lower surface 113*a* serving as an outer surface that faces the exterior of the casing 5, a lower plate portion upper surface 11*b* serving as an inner surface that faces the interior of the casing 5, a width direction first end surface 113*c*, and a width direction second end surface 113*d*.

The lower plate portion upper surface 113*b* faces the upper plate portion lower surface 112*b*. The upper plate portion upper surface 112*a*, is a surface of the base upper plate portion 112 on an opposite side to a surface (the upper plate portion lower surface 112*b*) thereof that opposes the base lower plate portion 113. The lower plate portion lower surface 113*a* is a surface of the base lower plate portion 113 on an opposite side to a surface (the lower plate portion upper surface 113*b*) thereof that opposes the base upper plate portion 112.

The first base side plate portion 114 includes a first side plate portion outer surface 114*a* serving as an outer surface that faces the exterior of the casing 5, a first side plate portion inner surface 114*b* serving as an inner surface that faces the interior of the casing 5, a first upper end surface 114*c* serving as a vertical direction end surface on the base upper plate portion 112 side, and a first lower end surface 114*d* serving as a vertical direction end surface on the base lower plate portion 113 side.

The second base side plate portion 115 includes a second side plate portion outer surface 115*a* serving as an outer surface that faces the exterior of the casing 5, a second side plate portion inner surface 115*b* serving as an inner surface that faces the interior of the casing 5, a second upper end surface 115*c* serving as a vertical direction end surface on the base upper plate portion 112 side, and a second lower end surface 115*d* serving as a vertical direction end surface on the base lower plate portion 113 side.

The second side plate portion inner surface 115*b* opposes the first side plate portion inner surface 114*b*. The first side plate portion outer surface 114*a* is a surface of the first base side plate portion 114 on an opposite side to a surface (the first side plate portion inner surface 114*b*) thereof that opposes the second base side plate portion 115. The second side plate portion outer surface 115*a* is a surface of the second base side plate portion 115 on an opposite side to a surface (the second side plate portion inner surface 115*b*) thereof that opposes the first base side plate portion 114.

The base upper plate portion 112 is disposed between respective upper end portions of the first and second base side plate portions 114, 115. The upper plate portion upper surface 112*a*, the first upper end surface 114*c*, and the second upper end surface 115*c* are disposed in an identical horizontal plane. The first end surface 112*c* of the base upper plate portion 112 either contacts or opposes via a very small gap the upper end portion of the first side plate portion inner surface 114*b*. The second end surface 112*d* of the base upper plate portion 112 either contacts or opposes via a very small gap the upper end portion of the second side plate portion inner surface 115*b*.

The base lower plate portion 113 is disposed between respective lower end portions of the first and second base side plate portions 114, 115. The lower plate portion lower surface 113*a*, the first lower end surface 114*d*, and the second lower end surface 115*d* are disposed in an identical horizontal plane. The first end surface 113*c* of the base lower plate portion 113 either contacts or opposes via a very small gap the lower end portion of the first side plate portion inner surface 114*b*. The second end surface 113*d* of the base lower plate portion 113 either contacts or opposes via a very small gap the lower end portion of the second side plate portion inner surface 115*b*.

The base upper plate portion 112 and the base lower plate portion 113 constitute a lateral plate portion according to the first embodiment. The first base side plate portion 114 and the second base side plate portion 115 constitute a vertical plate portion according to the first embodiment.

Figure 6:
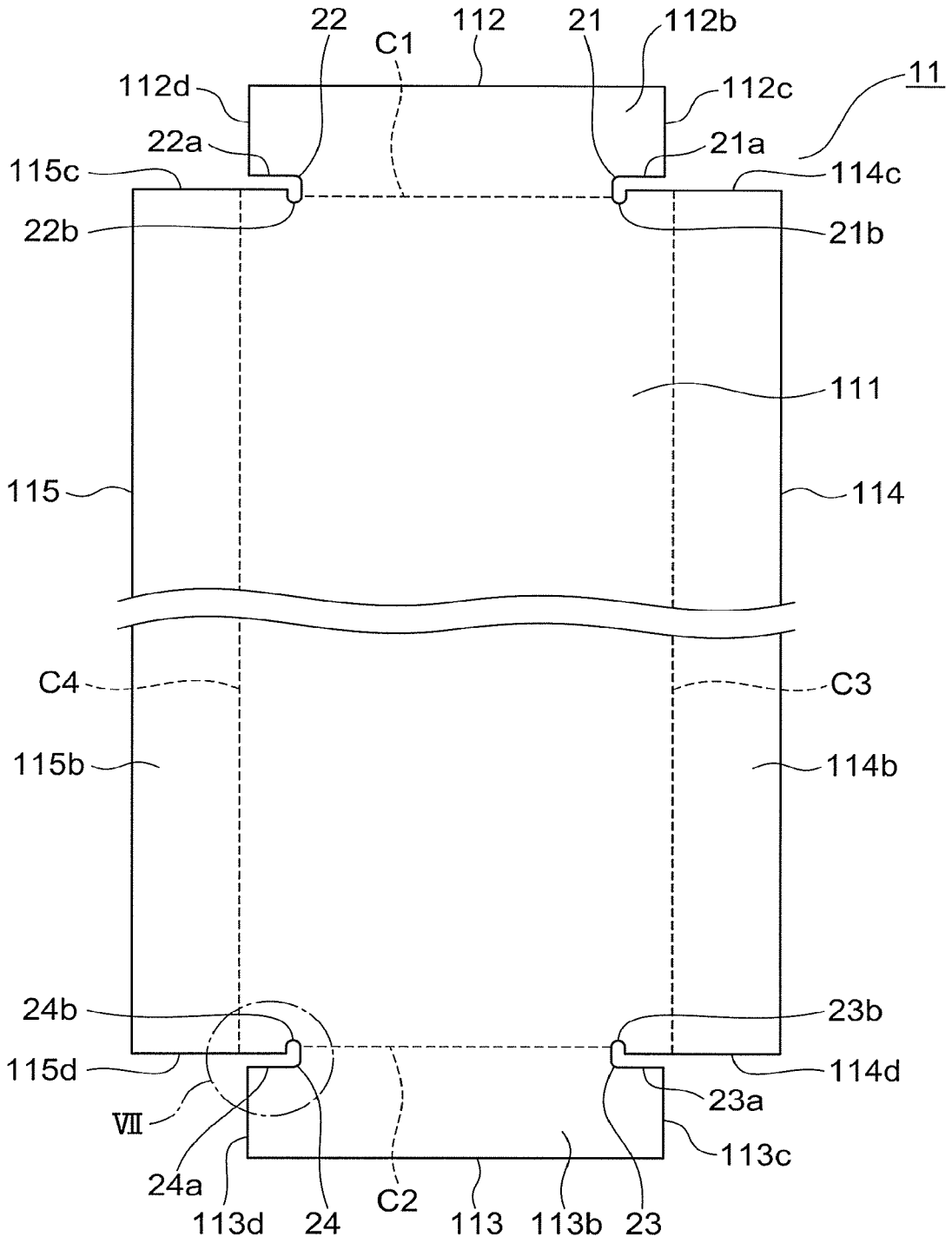
FIG. 6 is a development diagram showing the base of FIG. 5.
Figure 7:
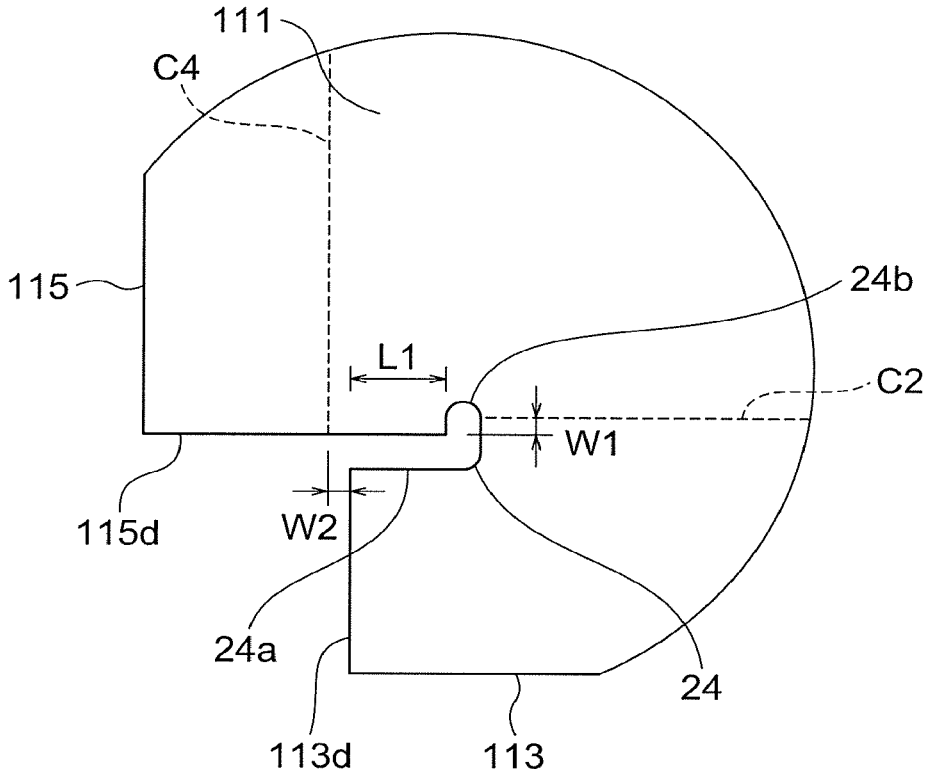
FIG. 7 is an enlarged front view showing a VII part of FIG. 6.
Figure 8:
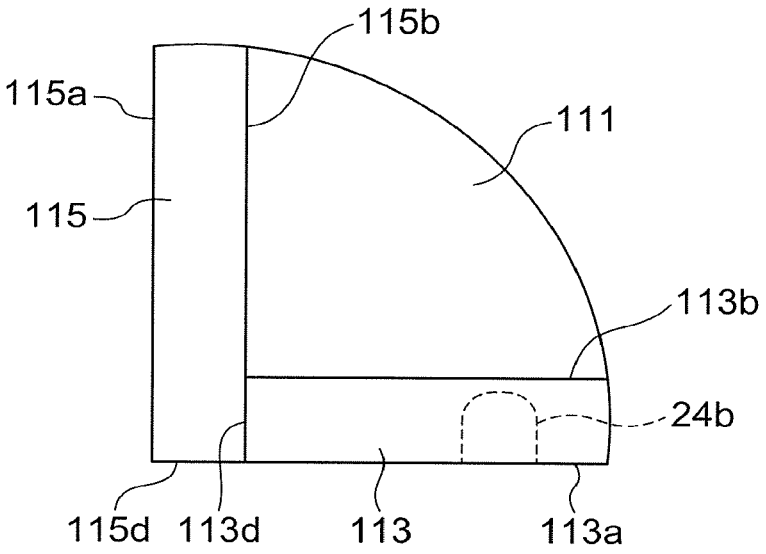
FIG. 8 is an enlarged front view showing a VIII part of FIG. 5.
Figure 9:
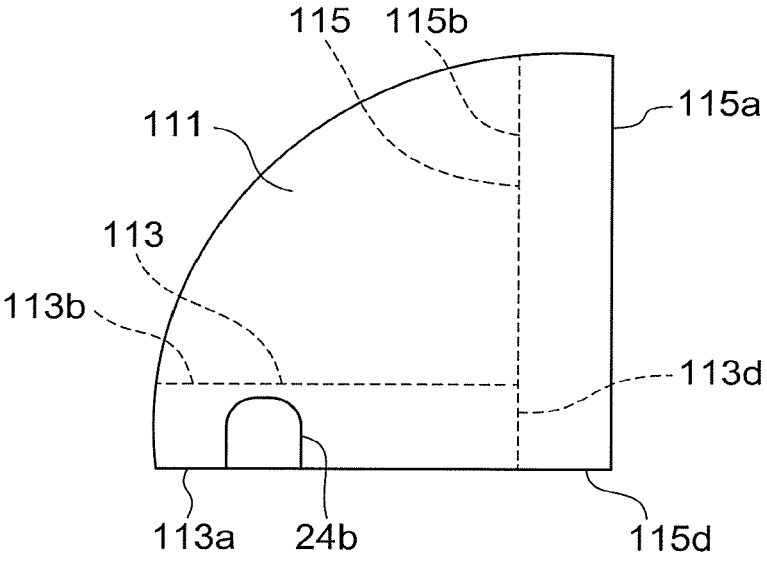
FIG. 9 is a back view of a part shown in FIG. 8.

FIG. 6 is a development diagram showing the base 11 of FIG. 5. FIG. 7 is an enlarged front view showing a VII part of FIG. 6. FIG. 8 is an enlarged front view showing a VIII part of FIG. 5. FIG. 9 is a back view of a part shown in FIG. 8. L-shaped first and second slits 21, 22 are provided between the back plate portion 111 and the base upper plate portion 112. Further, L-shaped third and fourth slits 23, 24 are provided between the back plate portion 111 and the base lower plate portion 113.

The first and second slits 21, 22 are disposed in left-right symmetry about the width direction (a left-right direction of FIG. 6) of the base 11. Similarly, the third and fourth slits 23, 24 are disposed in left-right symmetry about the width direction of the base 11.

The first slit 21 includes a first rectilinear portion 21*a* provided to extend in the width direction of the base upper plate portion 112 from a width direction end portion (a left-right direction end portion in FIG. 6) of the base upper plate portion 112 on the first base side plate portion 114 side, and a first projecting portion 21*b* that projects into the back plate portion 111 from an end portion of the first rectilinear portion 21*a* on an opposite side to the first base side plate portion 114.

The second slit 22 includes a second rectilinear portion 22*a* provided to extend in the width direction of the base upper plate portion 112 from a width direction end portion of the base upper plate portion 112 on the second base side plate portion 115 side, and a second projecting portion 22*b* that projects into the back plate portion 111 from an end portion of the second rectilinear portion 22*a* on an opposite side to the second base side plate portion 115.

The third slit 23 includes a third rectilinear portion 23*a* provided to extend in the width direction of the base lower plate portion 113 from a width direction end portion (a left-right direction end portion in FIG. 6) of the base lower plate portion 113 on the first base side plate portion 114 side, and a third projecting portion 23*b* that projects into the back plate portion 111 from an end portion of the third rectilinear portion 23*a* on an opposite side to the first base side plate portion 114.

The fourth slit 24 includes a fourth rectilinear portion 24*a* provided to extend in the width direction of the base lower plate portion 113 from a width direction end portion of the base lower plate portion 113 on the second base side plate portion 115 side, and a fourth projecting portion 24*b* that projects into the back plate portion 111 from an end portion of the fourth rectilinear portion 24*a* on an opposite side to the second base side plate portion 115.

In a condition where the base upper plate portion 112 and the base lower plate portion 113 are bent relative to the back plate portion 111, a surface of the base upper plate portion 112 that faces the first and second rectilinear portions 21*a*, 22*a* and a surface of the base lower plate portion 113 that faces the third and fourth rectilinear portions 23*a*, 24*a* overlap a surface of the back plate portion 111 on the opposite side to the wing wall 3*a*. In other words, wall surfaces of the rectilinear portions 21*a*, 22*a* on the base upper plate portion 112 side and wall surfaces of the rectilinear portions 23*a*, 24*a* on the base lower plate portion 113 side either contact the back plate portion 111 or oppose the back plate portion 111 via a very small gap.

A length L1 (FIG. 7) from an open end of the rectilinear portion 21*a*, 22*a*, 23*a*, 24*a* to the projecting portion 21*b*, 22*b*, 23*b*, 24*b* is preferably at least three times the plate thickness.

As shown in FIG. 7, by providing the slits 23, 24 with the respective projecting portions 23*b*, 24*b*, a center line C2 of a bent portion of the base lower plate portion 113 that is bent relative to the back plate portion 111 deviates upward from the first and second lower end surfaces 114*d*, 115*d* by W1. In vertical symmetry therewith, a center line C1 of a bent portion of the base upper plate portion 112 that is bent relative to the back plate portion 111 deviates downward from the first and second upper end surfaces 114*c*, 115*c* by W1.

Further, the first end surfaces 112*c*, 113*c* and the second end surfaces 112*d*, 113*d* deviate inwardly in the width direction of the base 11 by W2 from center lines C3, C4 of respective bent portions of the first and second base side plate portions 114, 115 that are bent relative to the back plate portion 111.

Hence, in the operation panel 4 for an elevator according to the first embodiment, the first and second slits 21, 22 are provided between the back plate portion 111 and the base upper plate portion 112, and the third and fourth slits 23, 24 are provided between the back plate portion 111 and the base lower plate portion 113. Further, the upper plate portion upper surface 112*a*, the first upper end surface 114*c*, and the second upper end surface 115*c* are disposed in an identical horizontal plane. Moreover, the lower plate portion lower surface 113*a*, the first lower end surface 114*d*, and the second lower end surface 115*d* are disposed in an identical horizontal plane. As a result, the exposure of angled portions in the four corners of the base 11 can be reduced.

Furthermore, the first to fourth slits 21, 22, 23, 24 are formed in an L shape, and therefore holes formed when the base upper plate portion 112 and the base lower plate portion 113 are bent, or in other words the projecting portions 21*b*, 22*b*, 23*b*, 24*b*, can be shifted to the back plate portion 111. As a result, the exposure of sharp angled portions can be reduced.

Moreover, the base 11 can be manufactured from a single steel plate, and therefore superior material efficiency is obtained.

Furthermore, neither welding nor corner chamfering implemented as post-processing is required, and therefore the amount of required processing can be reduced.

Further, the slits 21, 22, 23, 24 are provided between the back plate portion 111 and the base upper plate portion 112 and base lower plate portion 113, and therefore the slits 21, 22, 23, 24 can be made less obvious. As a result, deterioration of the design property can be prevented.

Second Embodiment

Figure 10:
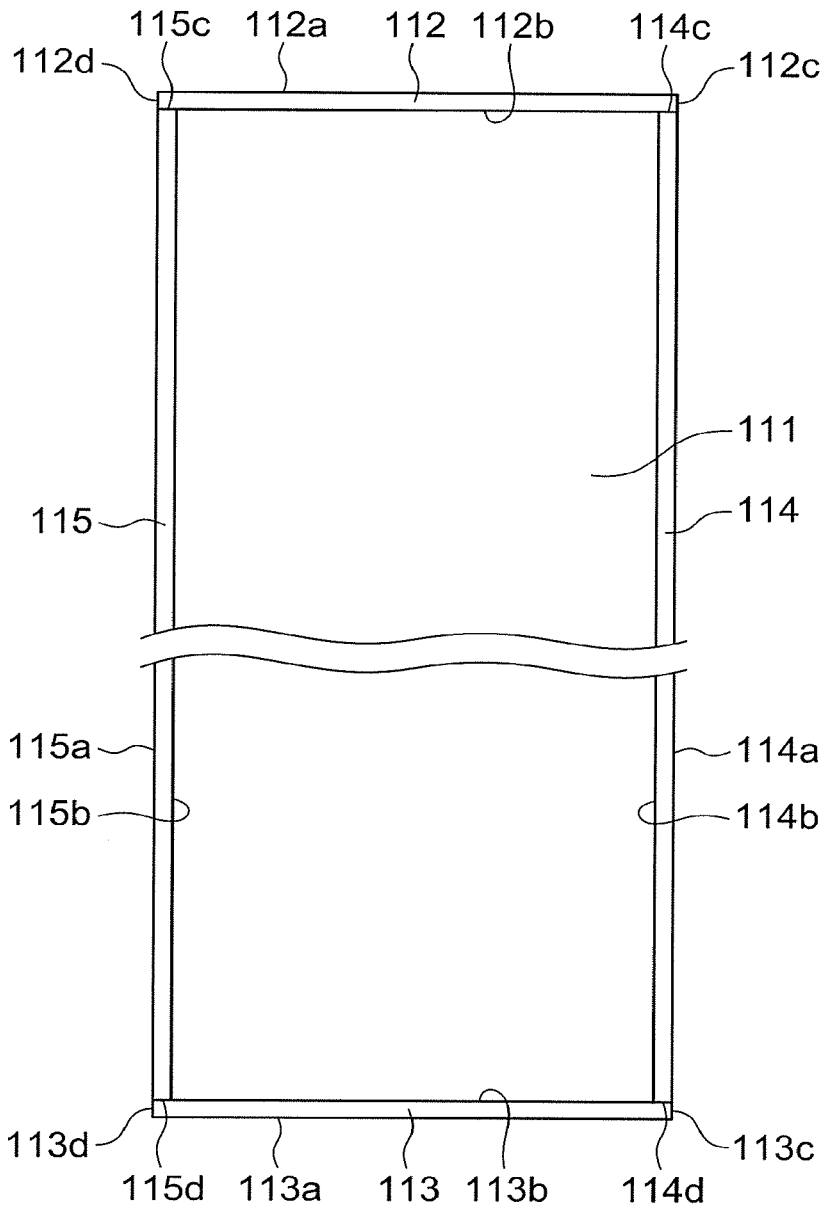
FIG. 10 is a front view showing a base of a casing of a car operation panel according to a second embodiment of this invention.
Figure 11:
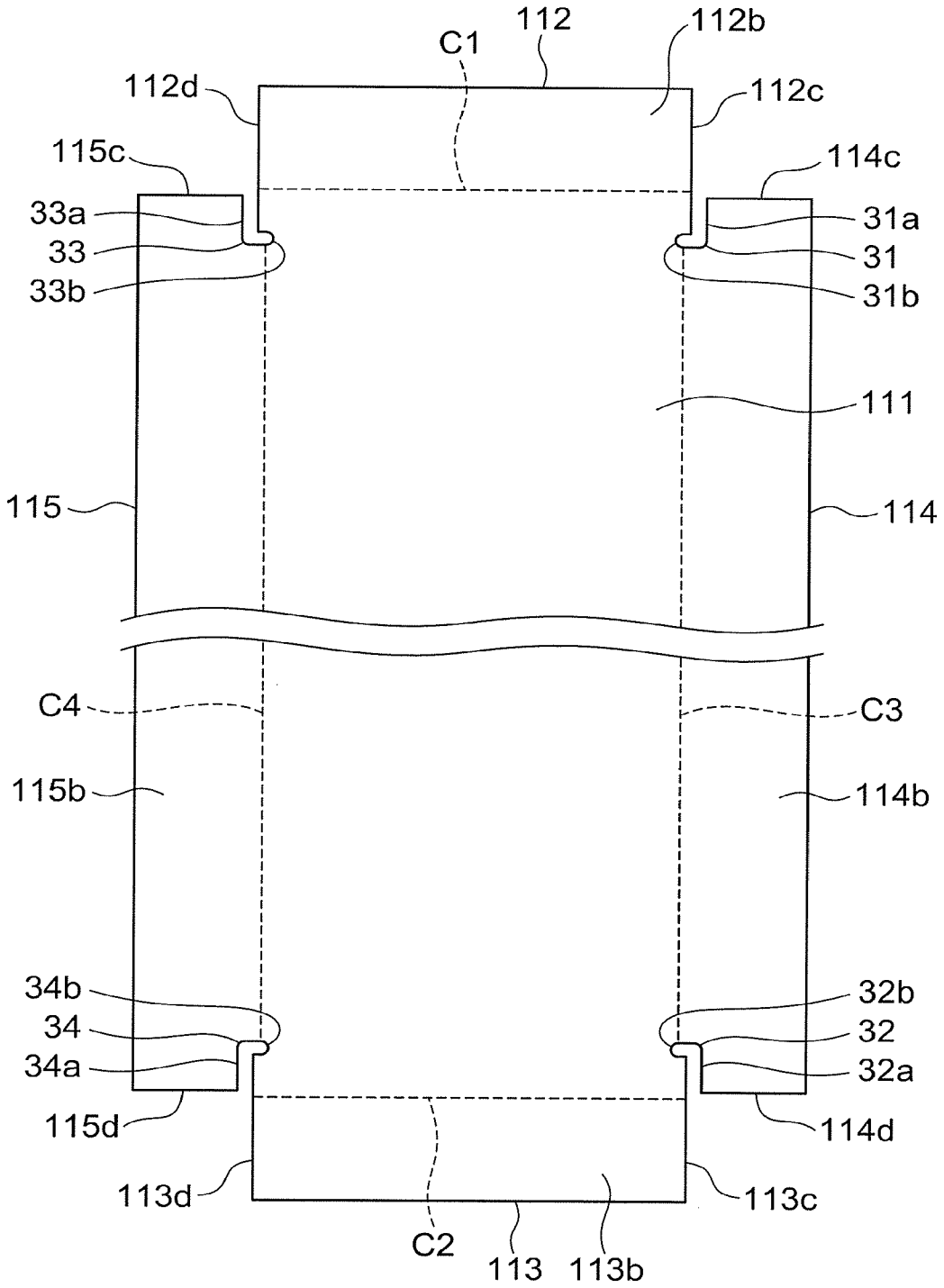
FIG. 11 is a development diagram showing the base of FIG. 10.

Next, FIG. 10 is a front view showing a base of a casing of a car operation panel according to a second embodiment of this invention, and FIG. 11 is a development diagram showing the base of FIG. 10.

The first base side plate portion 114 is disposed between a width direction first end portion of the base upper plate portion 112 and a width direction first end portion of the base lower plate portion 113. The first side plate portion outer surface 114*a* and the first end surfaces 112*c*, 113*c* are disposed in an identical vertical plane. The first upper end surface 114*c* either contacts or opposes via a very small gap the width direction first end portion of the upper plate portion lower surface 112*b*. The first lower end surface 114*d* either contacts or opposes via a very small gap the width direction first end portion of the lower plate portion upper surface 113*b*.

The second base side plate portion 115 is disposed between a width direction second end portion of the base upper plate portion 112 and a width direction second end portion of the base lower plate portion 113. The second side plate portion outer surface 115*a* and the second end surfaces 112*d*, 113*d* are disposed in an identical vertical plane. The second upper end surface 115*c* either contacts or opposes via a very small gap the width direction second end portion of the upper plate portion lower surface 112*b*. The second lower end surface 115*d* either contacts or opposes via a very small gap the width direction second end portion of the lower plate portion upper surface 113*b*.

The base upper plate portion 112 and the base lower plate portion 113 constitute a lateral plate portion according to the second embodiment. The first base side plate portion 114 and the second base side plate portion 115 constitute a vertical plate portion according to the second embodiment.

L-shaped first and second slits 31, 32 are provided between the back plate portion 111 and the first base side plate portion 114. Further, L-shaped third and fourth slits 33, 34 are provided between the back plate portion 111 and the second base side plate portion 115.

The first and second slits 31, 32 are disposed in vertical symmetry about the vertical direction of the base 11. Similarly, the third and fourth slits 33, 34 are disposed in vertical symmetry about the vertical direction of the base 11.

The first slit 31 includes a first rectilinear portion 31*a* provided to extend in a vertical direction from an upper end portion of the first base side plate portion 114, and a first projecting portion 31*b* that projects into the back plate portion 111 from an end portion (a lower end portion) of the first rectilinear portion 31*a* on an opposite side to the base upper plate portion 112.

The second slit 32 includes a second rectilinear portion 32*a* provided to extend in a vertical direction from a lower end portion of the first base side plate portion 114, and a second projecting portion 32*b* that projects into the back plate portion 111 from an end portion (an upper end portion) of the second rectilinear portion 32*a* on an opposite side to the base lower plate portion 113.

The third slit 33 includes a third rectilinear portion 33*a* provided to extend in a vertical direction from an upper end portion of the second base side plate portion 115, and a third projecting portion 33*b* that projects into the back plate portion 111 from an end portion (a lower end portion) of the third rectilinear portion 33*a* on an opposite side to the base upper plate portion 112.

The fourth slit 34 includes a fourth rectilinear portion 34*a* provided to extend in a vertical direction from a lower end portion of the second base side plate portion 115, and a fourth projecting portion 34*b* that projects into the back plate portion 111 from an end portion (an upper end portion) of the fourth rectilinear portion 34*a* on an opposite side to the base lower plate portion 113.

In a condition where the first and second base side plate portions 114, 115 are bent relative to the back plate portion 111, a surface of the first base side plate portion 114 that faces the first and second rectilinear portions 31*a*, 32*a* and a surface of the second base side plate portion 115 that faces the third and fourth rectilinear portions 33*a*, 34*a* overlap the surface of the back plate portion 111 on the opposite side to the wing wall 3*a*. In other words, wall surfaces of the rectilinear portions 31*a*, 32*a* on the first base side plate portion 114 side and wall surfaces of the rectilinear portions 33*a*, 34*a* on the second base side plate portion 115 side either contact the back plate portion 111 or oppose the back plate portion 111 via a very small gap.

By providing the slits 31, 32 with the respective projecting portions 31*b*, 32*b*, center lines C3, C4 of respective bent portions of the first and second base side plate portions 114, 115 that are bent relative to the back plate portion 111 deviate inwardly in the width direction of the base by W1 (FIG. 7) from the first end surfaces 112*c*, 113*c* and the second end surfaces 112*d*, 113*d*.

The first and second upper end surfaces 114*c*, 115*c* deviate downward by W2 (FIG. 7) from the center line C1 of the bent portion of the base upper plate portion 112 that is bent relative to the back plate portion 111. In vertical symmetry thereto, the first and second lower end surfaces 114*d*, 115*d* deviate upward by W2 from the center line C2 of the bent portion of the base lower plate portion 113 that is bent relative to the back plate portion 111. All other configurations are similar or identical to the first embodiment.

Likewise with this configuration, exposure of the angled portions in the four corners of the base 11 can be reduced. Further, the holes that are formed when the first and second base side plate portions 114, 115 are bent, or in other words the projecting portions 31*b*, 32*b*, 33*b*, 34*b*, can be shifted to the back plate portion 111, whereby exposure of the sharp angled portions can be reduced. Moreover, the base can be manufactured from a single steel plate, and therefore superior material efficiency is obtained. Furthermore, neither welding nor corner chamfering implemented as post-processing is required, and therefore the amount of required processing can be reduced.

Note that in the examples described above, the slits are disposed in the four corners of the base, but the slits do not necessarily have to be disposed in all four corners.

Further, this invention may also be applied to a landing operation panel for an elevator.

The invention claimed is:

1. An elevator operation panel, comprising a casing having a base and a cover joined to the base, wherein the base includes a back plate portion fixed to a wall, a lateral plate portion projecting at a right angle toward the cover side from a vertical direction end portion of the back plate portion, and a vertical plate portion projecting at a right angle toward the cover side from a width direction end portion of the back plate portion, the back plate portion, the lateral plate portion, and the vertical plate portion are formed by bending a single flat plate, an outer surface of the lateral plate portion, which faces the exterior of the casing, and a vertical direction end surface of the vertical plate portion on the lateral plate portion side are disposed in an identical plane, an L-shaped slit is provided between the back plate portion and the lateral plate portion, the slit includes a rectilinear portion provided to extend in a width direction of the lateral plate portion from a width direction end portion of the lateral plate portion on the vertical plate portion side, and a projecting portion that projects into the back plate portion from an end portion of the rectilinear portion on an opposite side to the vertical plate portion, and in a condition where the lateral plate portion is bent relative to the back plate portion, a surface of the lateral plate portion that faces the rectilinear portion overlaps a surface of the back plate portion on an opposite side to the wall.

2. An elevator operation panel, comprising a casing having a base and a cover joined to the base, wherein the base includes a back plate portion fixed to a wall, a lateral plate portion projecting at a right angle toward the cover side from a vertical direction end portion of the back plate portion, and a vertical plate portion projecting at a right angle toward the cover side from a width direction end portion of the back plate portion, the back plate portion, the lateral plate portion, and the vertical plate portion are formed by bending a single flat plate, an outer surface of the vertical plate portion, which faces the exterior of the casing, and a width direction end surface of the lateral plate portion on the vertical plate portion side are disposed in an identical plane, an L-shaped slit is provided between the back plate portion and the vertical plate portion, the slit includes a rectilinear portion provided to extend in a vertical direction from a vertical direction end portion of the vertical plate portion on the lateral plate portion side, and a projecting portion that projects into the back plate portion from an end portion of the rectilinear portion on an opposite side to the lateral plate portion, and in a condition where the vertical plate portion is bent relative to the back plate portion, a surface of the vertical plate portion that faces the rectilinear portion overlaps a surface of the back plate portion on an opposite side to the wall.

* * * * *